US010724262B2

(12) United States Patent
Rickman

(10) Patent No.: US 10,724,262 B2
(45) Date of Patent: Jul. 28, 2020

(54) METHOD OF SECURELY FITTING A COVER TO A POOL

(71) Applicant: Charlie Rickman, Smithland, KY (US)

(72) Inventor: Charlie Rickman, Smithland, KY (US)

( * ) Notice: Subject to any disclaimer, the term of this patent is extended or adjusted under 35 U.S.C. 154(b) by 0 days.

(21) Appl. No.: 15/878,376

(22) Filed: Jan. 23, 2018

(65) Prior Publication Data

US 2019/0024400 A1 Jan. 24, 2019

Related U.S. Application Data

(60) Provisional application No. 62/449,418, filed on Jan. 23, 2017.

(51) Int. Cl.
*E04H 4/10* (2006.01)
*E04H 4/00* (2006.01)

(52) U.S. Cl.
CPC ..... *E04H 4/10* (2013.01); *E04H 4/0056* (2013.01)

(58) Field of Classification Search
CPC ..... E04H 4/10; E04H 4/103; E04H 4/105; E04H 4/106; E04H 4/108; B60J 7/104; B60J 7/1858; Y10T 24/44983
USPC ..... 296/100.16; 160/402, 403; 24/570
See application file for complete search history.

(56) References Cited

U.S. PATENT DOCUMENTS 4,011,607 A * 3/1977 Davidoff ..... E04H 4/10 220/319
5,095,557 A * 3/1992 Keyes ..... E04H 4/10 4/498
5,373,590 A * 12/1994 Svae ..... E04H 4/105 4/498

* cited by examiner

*Primary Examiner* — Janie M Loeppke
(74) *Attorney, Agent, or Firm* — Julie Tennyson; Marcum Tennyson PLLC

(57) ABSTRACT

A method, system, and apparatus of attaching a cover to a pool using a cable around the pool. Then attaching a holder to the cable and inserting a card in the holder to hold the cable inside the holder. The holder, the card, and the cable are a holder assembly. The holder assembly is rolled into a cover until tight.

6 Claims, 4 Drawing Sheets

METHOD OF SECURELY FITTING A COVER TO A POOL

CROSS REFERENCE TO RELATED APPLICATIONS

This application is a continuation in part of. This application claims the benefit of U.S. Provisional Application Ser. No. 62/449,418 filed by Charlie Rickman on Jan. 23, 2017 and entitled "Cover Saver Plus" which is incorporated herein by reference.

FIELD OF INVENTION

The invention relates to a system, method, and apparatus for covering a pool for the winter.

BACKGROUND OF THE INVENTION

Above-ground pools should be covered every year to keep leaves and other debris from accumulating in them during the seasons where it is too cold to swim. In many locations, above-ground pools are uncovered only in summer. Most pools are protected from leaves and debris with a cable threaded through grommets of a cover. The problem with this method is the wind can get under the cover and destroy it or tear it so that debris gets under the cover. Also the cover may need to be replaced more than once between summers. The wind can also tear grommets out of the pool cover.

The cable threaded through grommets can rub against the ribs or upright posts. This causes unsightly marks that show when the cover is removed. The cable can also wedge behind your upper upright trim and cause damage. The cover could also warp top seats. The current invention causes the pool cover to fit on the pool in an attractive fashion.

SUMMARY OF THE INVENTION

The present invention is a holder placed on a cable with a card inserted above the cable. The end of the cover is then placed over the holder and between the pool wall and rolled under one or more times to secure the cover. The holders are placed around the pool at enough intervals to hold the cover on securely.

DETAILED DESCRIPTION OF THE INVENTION

Figure 1:
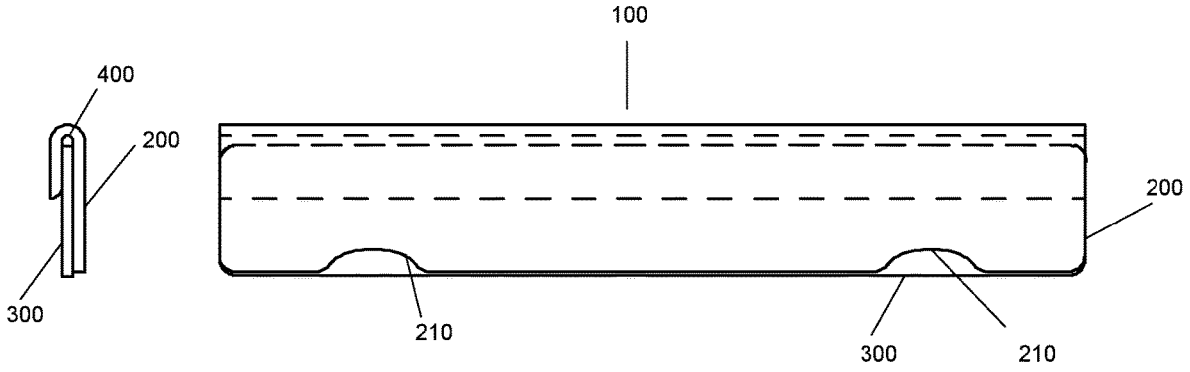
FIG. 1 is a front and side view of a holder assembly.

FIG. 1 shows a holder assembly 100 with a holder 200 in a j-shape, a card 300, and a cable 400. The holder 200 can be in a u-shape. The holder 200 has one or more cutouts 210 on the long side of the j-shape. Inside the holder 200 a cable 400 is inserted. The cable 400 can be wire, non-metallic, or a combination of wire and non-metallic. Above the cable 400 one or more cards 300 are placed. The holder 200 and card 300 can be plastic or other material that will allow the holder 200 and card 300 to be fitted together tightly. The cutouts 210 can be circular, square, or irregular. The cutouts

210 extend completely through the long side of the j-shaped holder 200 so that the user may take the card 300 out to remove the holder 200 for storage in the winter.

Figure 2:
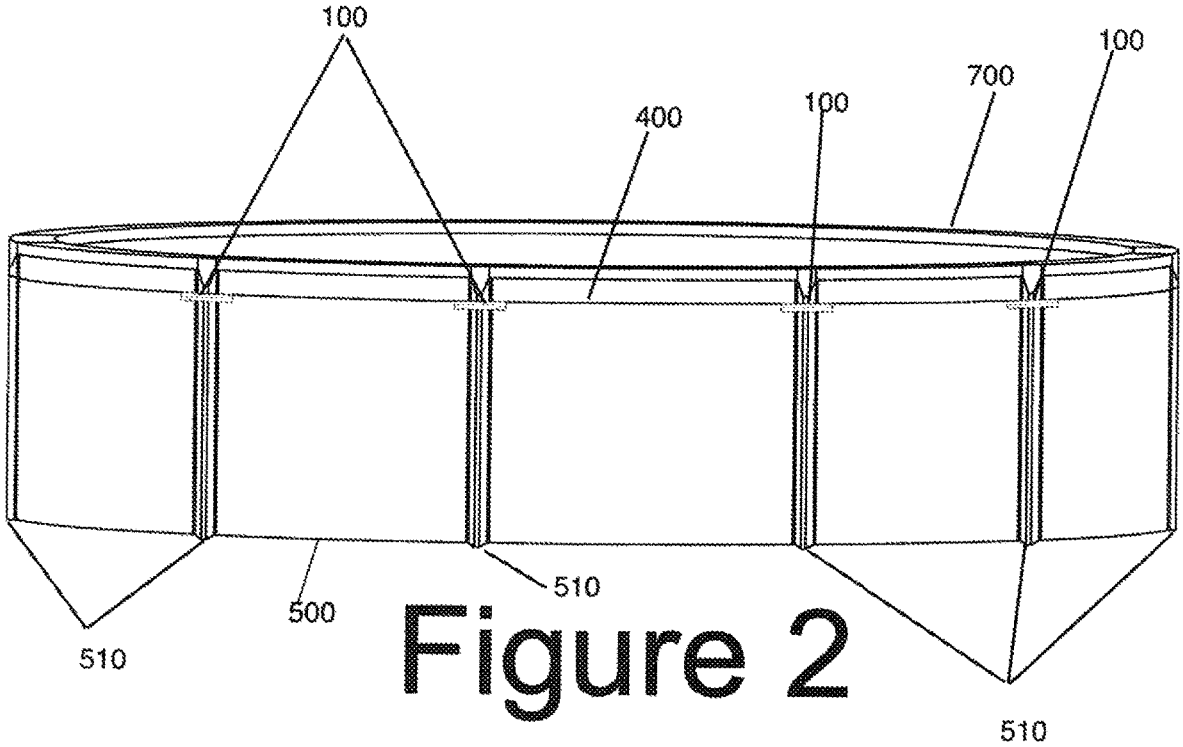
FIG. 2 is a view of the holder assembly without a cover.

FIG. 2 depicts a pool 500 that is above-ground. Above-ground pools 500 are generally round or oval shaped. A cable 400 is placed around the outside circumference of the pool 500. The cable 400 is secured together by a ratchet or other fastener. The ratchet can be used to tighten the cable 400. The holder assembly 100 is placed on the cable 400 on or near a rib 510. The rib 510 vertically ends from the ground or below the ground up to the top seat 700 of the pool on the outer circumference of the pool 510. The pool 510 generally has more than one rib 510 to hold the pool 500 up and together.

Figure 3:
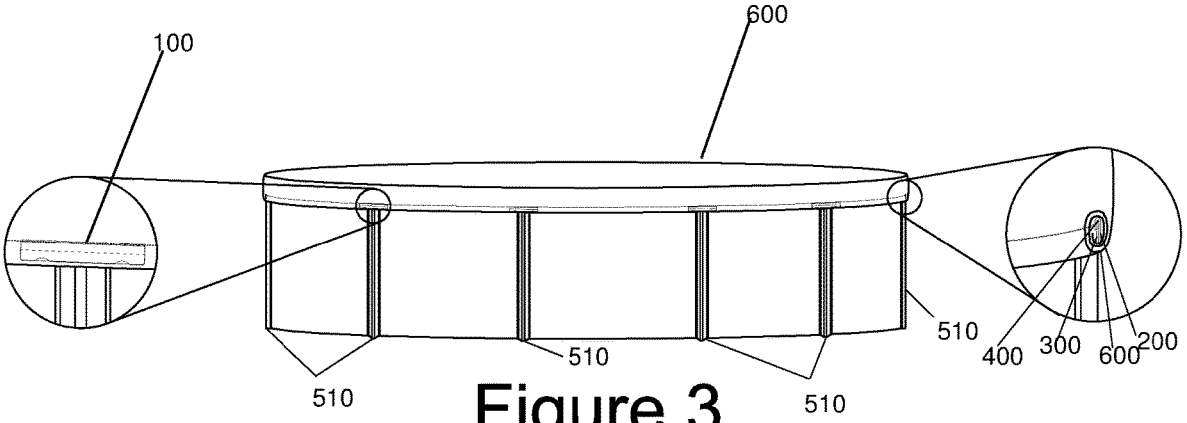
FIG. 3 is view of the inside of the cover with a close-up view of the holder assembly.

FIG. 3 is a cutaway of the holder assembly 100 inside a cover 600. For the ease of reference the cover 600 is depicted as transparent. However, most covers 600 are opaque. FIG. 3 also shows a side cutaway of the holder assembly 100. The holder assembly 100 is shown rolled inside layers of cover 600. The cable 400 is shown inserted into the holder 200 with the card 300 above it. The card 300 can be square, rectangular, circular, oval, or irregular. The sides of the holder 100 is in a j-shape. The back and front of the holder 200 can be any shape but the preferred shape is rectangular.

Figure 4:
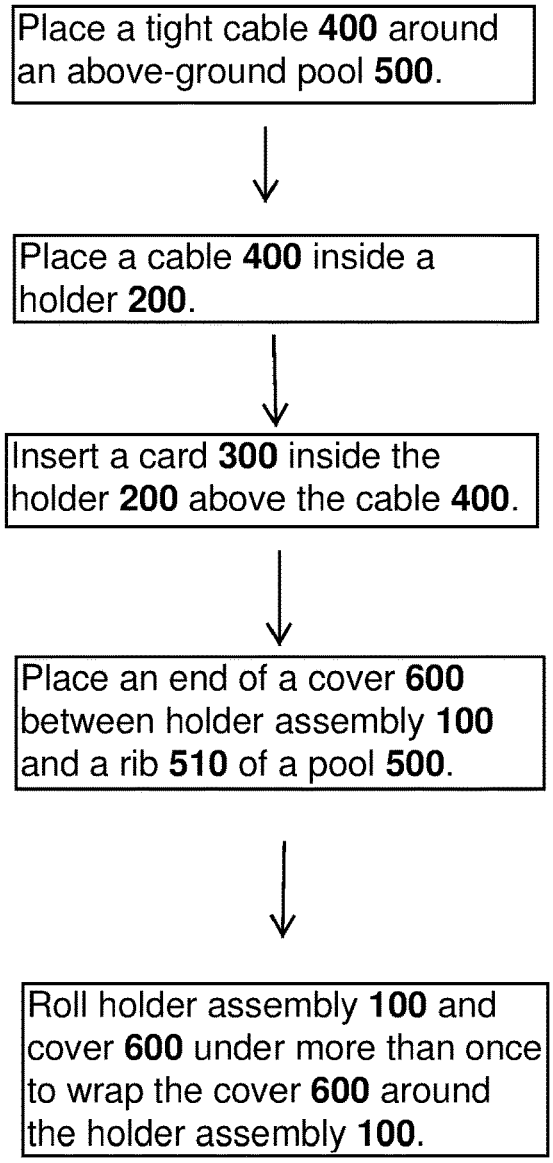
FIG. 4 is a flow chart of a method using the holder assembly.

FIG. 4 is a flow chart showing the steps of the method of installing a pool cover 600. The first step is to place a tight cable 400 around an above-ground pool 500. Then place the cable 400 inside a holder 200. Next, insert a card 300 inside the holder 200 above the cable 400. Then place an end of a cover 600 between a holder assembly 100 and a rib 510 of a pool 500. Finally, roll holder assembly 100 and cover 600 under more than once to wrap the cover 600 around the holder assembly 100. The process should be repeated with each holder assembly 100 that is over a rib 510. Not every rib 510 has to have a holder assembly 100. In order for the rolling to work the user must pull the holder assembly 100 away from the ribs 510 at every turn. The holder assembly 100 must be rolled until it is nice and snug under the top seat 700 shown in FIG. 2 of the pool 500. The preferred embodiment is the cable 400 is at the bottom of the holder 200 so that the viewer sees a right side up J-shaped holder 200 from the side. After all of the holder assemblies 200 have been rolled into the cover 600, the user may re-adjust any holder 200. The cable 400 must stay tight and secure throughout the whole season. If a user has an oval pool 500, there is no pressure from the cable 400 on a few of the ribs 510 on each straight side of the pool 500. Therefore roll the holder assembly 100 as normal, but you must purchase other types of cover clips and place over each holder assembly 100. The ends of an oval pool 500 will not need any cover clips on the sides.

What is claimed is:

1. A method of placing a cover on a pool comprising:

placing a tight cable around an above-ground pool;

placing the cable inside a holder;

inserting a card inside the holder above the cable, the holder, card, and cable make up a holder assembly;

placing an end of the cover under the holder assembly and between the holder assembly and a rib of a the pool;

rolling the holder assembly and the cover under more than once to wrap the cover around the holder assembly.

2. An apparatus for fitting a cover to a pool comprising:

a holder assembly comprising a holder having a cable inserted into a bottom U-bend of the holder and a card placed on top of the cable to secure the cable inside the holder;

a cover for a pool disposed between a rib on the pool and the holder assembly, wherein a bottom edge of the cover is placed adjacent to the holder assembly; and wherein the cover is configured to be wound around the holder assembly one or more times until the cover reaches a top seat of the pool.

3. The apparatus of claim 2 further comprising a plurality of cards.

4. The apparatus of claim 2 further comprising at least one cutout on a long side of the holder.

5. The apparatus of claim 2 wherein the holder assembly is positioned in front of the rib.

6. The apparatus of claim 2 further comprising a plurality of holder assemblies and a plurality of ribs on the pool, wherein each of the plurality of holder assemblies is positioned in front of each of the plurality of ribs on the pool.

* * * * *